United States Patent [19]

Bridgwater

[11] Patent Number: 4,694,818

[45] Date of Patent: Sep. 22, 1987

[54] FIREPLACE GRATE FOR GAS FIRED FIREPLACE INCLUDING FORCED AIR HEAT EXCHANGER

[75] Inventor: Jon Bridgwater, Morton, Ill.

[73] Assignee: Morton Metalcraft Company, Morton, Ill.

[21] Appl. No.: 893,965

[22] Filed: Aug. 7, 1986

[51] Int. Cl.[4] ..... F24B 7/00

[52] U.S. Cl. ..... 126/121; 126/92 R; 126/127; 126/163 R; 126/164

[58] Field of Search ..... 126/92 R, 121, 127, 126/163 R, 164

[56] References Cited

U.S. PATENT DOCUMENTS

| | | | |
|---|---|---|---|
| 3,240,206 | 3/1966 | Schutt | 126/121 |
| 3,362,395 | 6/1968 | Peterson | 126/92 R |
| 3,385,651 | 5/1968 | Rasmussen et al. | 126/92 R X |
| 3,583,845 | 6/1971 | Pulone | 126/127 X |
| 3,671,175 | 6/1972 | Campbell | 126/127 X |
| 3,871,355 | 3/1975 | Henry | 126/127 |
| 4,078,542 | 3/1978 | Young et al. | 126/164 |
| 4,408,594 | 10/1983 | Shimek et al. | 126/121 |
| 4,512,329 | 4/1985 | Sweet | 126/121 |

OTHER PUBLICATIONS

Heat-N-Glo Fireplace Products, Inc.—brochure entitled "Gas Log Heater".

Heat-N-Glo Fireplaces—brochure entitled "Now You See It . . . Now You Don't".

Heat A Grate, Tamro Industries, Inc.—brochure entitled "Tired of Heating The Outdoors?"

Morton Hearth Furnace Brochure No. 2915-027 entitled "Now You Can Enjoy All the Warmth of America's Finest Heat Booster in Your Small Fireplace".

Morton Hearth Furnace Brochure No. 2915-028 entitled "America's Finest Fireplace Heat Booster Is More Than a Lot of Hot Air".

*Primary Examiner*—Margaret A. Focarino

*Attorney, Agent, or Firm*—Allegretti, Newitt, Witcoff & McAndrews, Ltd.

[57] ABSTRACT

An improved fireplace heat transfer unit includes a gas burner tube in a layer of sand retained in a trough beneath air conduction tubes arranged transversely to the burner tube. The air transfer tubes are all connected to a manifold at the rear of the fireplace grate unit which receives air for transport through the conduits and ejection into a room.

6 Claims, 6 Drawing Figures

FIREPLACE GRATE FOR GAS FIRED FIREPLACE INCLUDING FORCED AIR HEAT EXCHANGER

FIELD OF THE INVENTION

The invention relates to an improved fireplace grate and heat transfer unit of the type which uses natural gas as a fuel.

BACKGROUND OF THE INVENTION

U.S. Pat. No. 4,078,542 discloses a fireplace grate and forced air heat exchanger useful in a wood burning fireplace. The device is useful for circulating air from a room through a manifold and tube which support burning logs for discharge into the room. The air passing through the manifold and tubes is heated thereby enhancing the utility of the fireplace by improving the efficiency of heat transfer from the fireplace to the room.

There are numerous other issued patents disclosed in U.S. Pat. No. 4,078,542 which relate to various heat exchangers incorporated with a fireplace grate for the purpose of improving efficiency of heat transfer from the fireplace to a room. The prior art devices are designed for use with combustible materials, principally wood in the form of logs.

In the modern home, however, many fireplaces have been converted so that natural gas is burned in the fireplace. The natural gas is combusted to provide flames that pass through synthetic logs or coals. Heretofore a fireplace grate has been designed for use with gas and also utilizing a manifold and blower construction to enhance the efficiency of heat transfer from the fireplace into a room. Such a product is manufactured by Heat-N-Glo Fireplace Products, Inc. of Burnsville, Minn.

While such a gas combusting fireplace heat transfer unit appears to be desirable, such prior units are believed to be lacking in one or more important characteristics; for example, simplicity and therefore economy of construction, efficiency of heat transfer, attractiveness of design, suitable alignment and maintenance of alignment of the non-combustible, synthetic logs or coals.

SUMMARY OF THE INVENTION

Accordingly, an object of the present invention is to overcome the deficiencies of the prior art indicated above.

Yet a further object of the invention is to provide an improved heat transfer device for fireplaces particularly fireplaces utilizing natural gas as a fuel.

Another object of the invention is to provide an improved and inexpensive fireplace grate for improved heat transfer.

Another object of the invention is to provide a fireplace heat transfer unit utilizing natural gas as a fuel which can be easily incorporated within an existing fireplace opening and which does not interfere with the operation of a fireplace screen or door.

Yet a further object of the present invention is to provide a fireplace heat transfer unit which yields measurable improvement in heat output into a room wherein the fuel used in the fireplace is natural gas.

Yet another object of the invention is to provide a fireplace heat transfer unit which includes means for properly supporting and spacing synthetic, non-combustible logs and/or coals with respect to one another as well as with respect to a burner construction associated with the natural gas fireplace unit.

Briefly, therefore, the present invention is an improved fireplace heat transfer unit for placement in a fireplace of the type having a floor, a back wall and a front wall. The unit includes a forced air fed distribution manifold adapted to extend across the back wall of the fireplace opening, a series of heat transfer conduits extending transversely from the manifold toward the front of the fireplace opening, each conduit including an emission orifice for jetting air direction into a room, a frame for support of these components, an air supply tube connected to the manifold, a blower for forcing air through the air supply tube, manifold and conduits, a plurality of synthetic combustibles such as logs, and a gas supply tube supported below the frame at an appropriate distance for emission of ignitable gas as it flows over the logs. In a preferred embodiment, the gas supply tube extends transversely with respect to the conduits and is also positioned within a trough or pan below the conduits. The supply tube is covered by sand in order to more effectively disperse the gas. The construction is especially useful for effective combustion of natural gas in a fireplace and simultaneous heat transfer of air circulated through the fireplace.

BRIEF DESCRIPTION OF THE DRAWING

The objects, advantages and other features of the invention will be set forth in greater detail in the description which follows. In the detailed description which follows, reference will be made to the drawing comprised of the following figures.

DESCRIPTION OF THE PREFERRED EMBODIMENT

Figure 1:
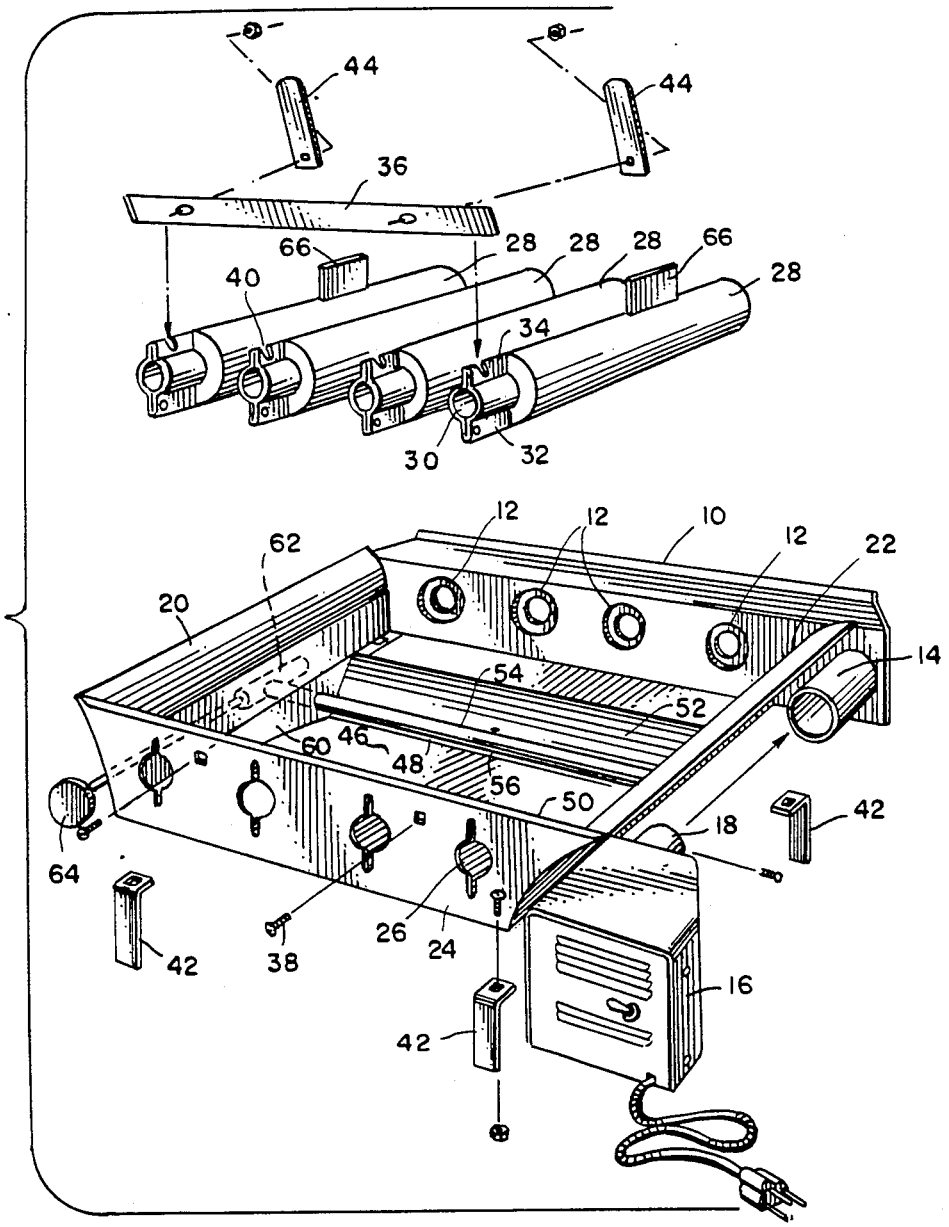
FIG. 1 is an exploded perspective view of the component parts of the improved fireplace grate.
Figure 2:
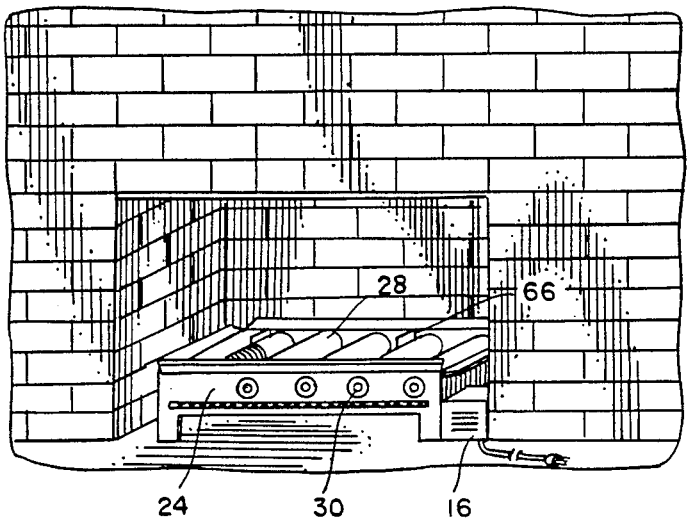
FIG. 2 is an assembled perspective view of the device depicted in FIG. 1 as positioned in a typical fireplace.

Referring to the figures, the improved fireplace grate of the invention is a rugged yet simple construction which includes a manifold 10 positioned within the fireplace along the rear wall generally parallel to the rear wall. The manifold 10 is comprised of a hollow rectangular parallelepiped or plenum chamber having a series of equally spaced apertures 12 along the inside wall of the manifold directed toward the front of the fireplace. An air supply inlet tube 14 connects at one end of manifold 10 to the interior a blower which directs air through a connecting tube 18 to the inlet tube 14, thence through the manifold 10 and the apertures 12.

The manifold 10 forms the rear member of a generally rectangular frame comprised additionally of connected side members 20 and 22 and a front cross member 24. The frame is supported above the hearth of the fireplace by legs 42 positioned at the four corners of the rectangular frame. The front cross member 24 includes a series of keyed apertures 26 which are aligned with respective apertures 12 of manifold 10. Air flow conduits 28 connect between respective manifold apertures 12 and keyed apertures 26. Conduits 28 are hollow tubes having a restricted outlet orifice 30 as defined by a reduced forward cross section of the conduit 28. The reduced forward cross section of the conduit 28 also includes upwardly and downwardly extending key members 32 and 34 which cooperate respectively with the keyed aperture 26 to maintain alignment or conduits 28.

A retaining bar 36 attached by fasteners 38 to the front frame member 24 cooperates with slots 40 in the key member 32 of each conduit 28 to retain the conduits 28 aligned and generally immovable within the frame. Andirons 44 are also retained on the frame by means of the fasteners 38 which retain the retaining bar 36. The andirons 44 prevent material such as the synthetic logs from accidentally falling from the frame and out of the front of the fireplace. Andirons 44 are also a decorative feature.

Attached to the bottom of the frame by means of appropriate fastening means is a pan 46. The pan 46 is suspended below the conduits 28 and defines a longitudinal trough 48 which is generally transverse to the direction of the conduits 28. The trough 48 is thus formed by first and second inclined panels 50 and 52 which join together to define the pan 46 having the trough 48 with a generally V-shaped cross section. Positioned within the trough 48 toward the bottom thereof is a gas burner tube 54 having gas discharge openings or orifices 56 which depend downwardly with respect to the frame, conduits and the like. The tube 54 has a generally constant diameter though it is flared at its closed end 55. The tube 54 includes the openings or orifices 56 generally uniformly distributed along the bottom surface thereof.

Figure 5:
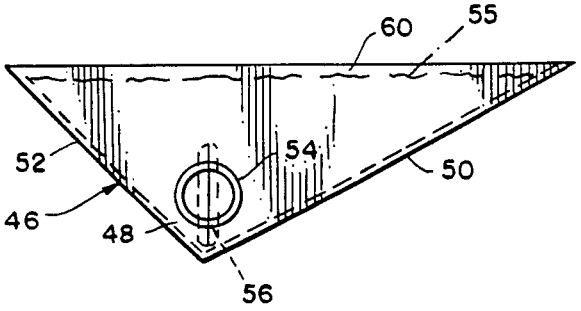
FIG. 5 is an end view of the pan associated with the fireplace grate.
Figure 6:
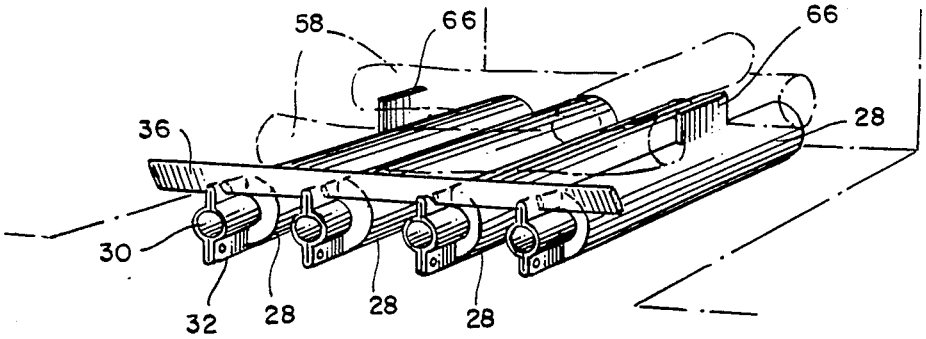
FIG. 6 is a detailed view of the positioner plate associated with the air flow conduits for positioning the synthetic logs associated with the device.

In operation, the tube 54 is covered with a layer of sand 55 in FIG. 5 which is retained by the pan 46. Natural gas is discharged through the orifices 56 into the sand 55. Since the gas is generally lighter than air, it migrates upwardly through the sand in a diffuse pattern where it ignites as it passes between the conduits 28 and over a set of synthetic logs 58. The logs or combustibles 58 may constitute lava or other rock material which simulates logs or coals that are retained on top of the conduits 28.

Figure 3:
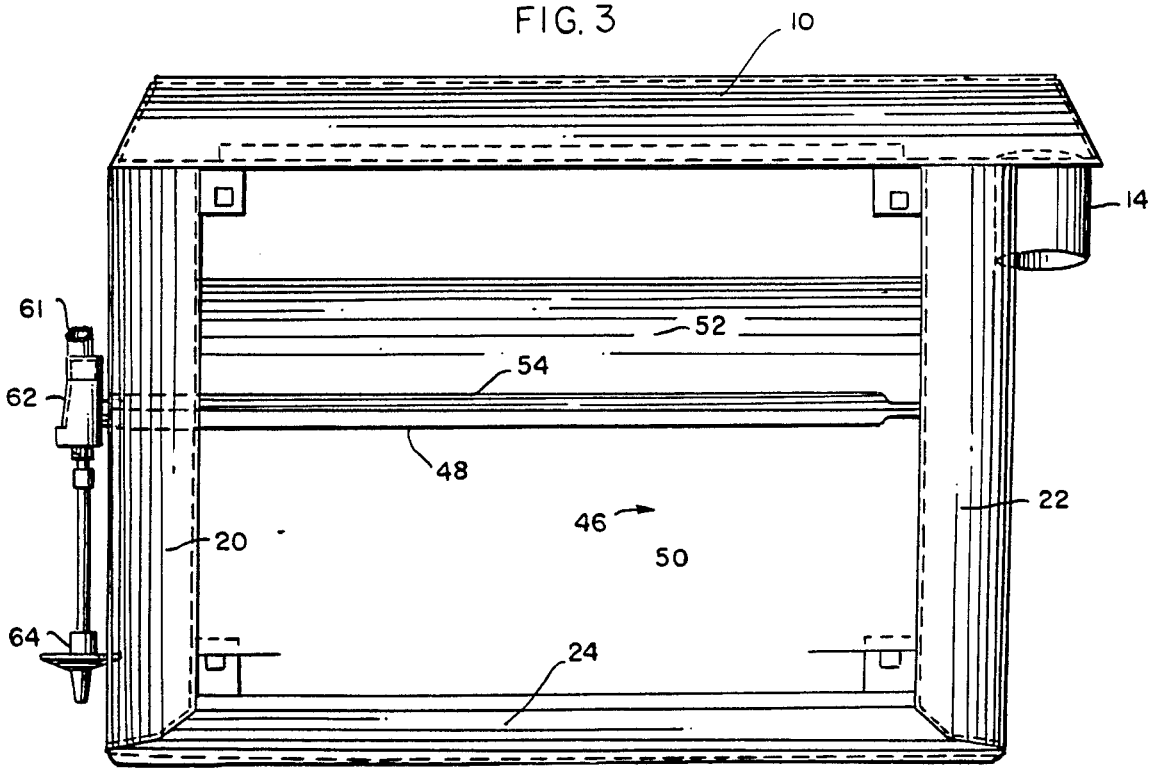
FIG. 3 is a top plan view of the frame for the fireplace grate.
Figure 4:
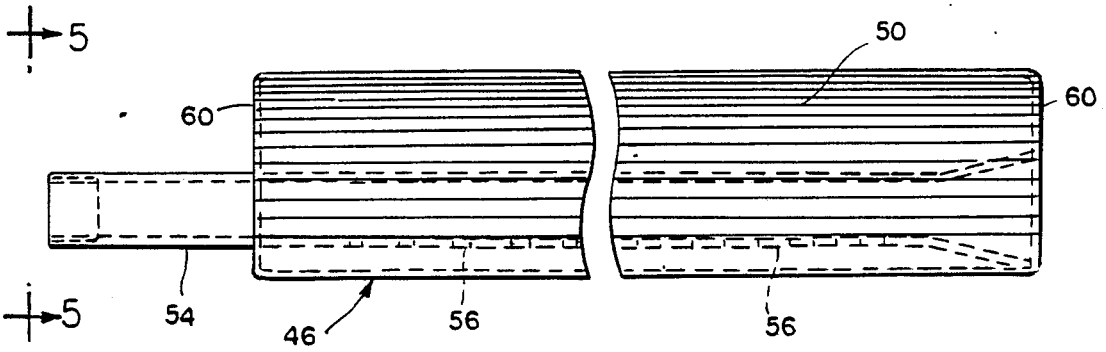
FIG. 4 is a side view of the pan associated with the fireplace grate.

Referring again to the burner tube 54, the tube 54 projects through a side wall 60 of the pan 46. The tube 54 thus connects with a gas supply valve 62 on the outside of the pan 46. The gas supply valve 62 connects with a gas supply line 61 in FIG. 3 and is controlled by a manual valve lever 64. In this manner the supply of gas to the unit is controlled. The gas may be ignited by an automatic ignition system such as known to those skilled in the art of gas log construction. Alternatively, the gas may be ignited, for example by a match.

Referring now to the conduits 28, each conduit is, as previously explained, connected to the manifold 10 and defines an air flow path through the region of gas combustion. Additionally, the conduits 28 serve the function of retaining the synthetic combustibles 58 in a properly spaced and oriented relationship with respect to the gas burner tube 54 so that the most efficient combustion can be effected in order to maximize heat transfer through the conduits 28. Consequently, one or more conduits 28 include a vertical positioner plate 66 projecting from the top of the conduit. The plate 66 provides a mechanism for spacing the synthetic logs, for example, and also for supporting the logs relative to one another. The size and position of the plate 66 is devised to enhance the combustion of the natural gas within the unit and thereby enhance the efficiency of heat transfer from the combustible gas to the conduit 28.

It is noted that the construction of the present invention is not useful with respect to actual combustible materials. Rather, it is designed for use in association with synthetic combustibles such as molded, non-flammable logs. Nonetheless, the construction or unit provides for the maximum efficiency of heat transfer between the combusted fuel in the unit and air passing through the conduits. This is accomplished by the appropriate spacing of the tubes 54 beneath the conduits 28, the appropriate maintenance of the shape and size of the trough or pan 46; the appropriate compactness or density as well as level of sand within the pan 46; the spacing and number of conduits 28; the diameter or size of the conduits 28 relative to the capacity of the blower 16; and the utilization of the positioner plates 66.

Thus, while there has been set forth a preferred embodiment of the invention, it is to be understood that the invention is limited only by the following claims and their equivalents.

What is claimed is:

1. An improved fireplace heat transfer unit for placement in a fireplace of the type having a floor, a back wall, and a front opening, said unit comprising, in combination:

a forced air fed distribution manifold adapted to extend across the rear of a fireplace substantially parallel to the back wall thereof;

a series of heat transfer conduits each defining a respective heat transfer chamber connected with said manifold extending therefrom toward the fireplace opening and including an emission orifice for jetting air directly into a room;

a generally rectangular frame having a rear member defined by the manifold, opposite side members and a front member for supporting the heat transfer conduits;

means for supporting the frame above the floor;

an air supply tube connected to the manifold;

blower means for forcing air through said tube into the manifold, then through the conduits and from the emission orifices, said blower means being positioned within the fireplace front opening when the unit is operating;

a plurality of synthetic, non-flammable, model combustibles supported on the heat transfer conduits generally above the frame;

a pan supported by the frame at the bottom of the frame and beneath the heat transfer conduits to define an enclosure which has the frame forming the sides thereof and the pan generally forming the bottom thereof with the top being generally open, said heat transfer conduits extending through the enclosure from the manifold;

gas supply means including a gas burner tube, said burner tube generally transverse to the heat transfer conduits and supported by the pan intermediate the rear and front members of the frame and below the conduits comprising means for providing a gas supply for ignition and burning of gas in the region of the transfer conduits and the model combustibles; and a layer of sand covering the gas burner tube for dispersal of gas discharged from the tube to within the enclosure defined by the frame for combustion within the enclosure around the tubes and also around the model combustibles.

2. The unit of claim 1 including a pan below the gas tube supported on the frame.

3. The unit of claim 1 wherein the pan defines a longitudinal trough for receipt of the gas supply tube.

4. The unit of claim 2 wherein the pan includes a layer of sand covering the tube for dispersal of gas discharged from the tube.

5. The unit of claim 1 including spacer means projecting from the conduits for maintaining the synthetic combustibles spaced to enhance combustion of gas.

6. The unit of claim 1 wherein at least some of the orifices are restricted.

* * * * *